US006634042B2

(12) United States Patent
Blossman

(10) Patent No.: US 6,634,042 B2
(45) Date of Patent: Oct. 21, 2003

(54) CRIB MATTRESS COVER

(76) Inventor: Raleigh Blossman, 402 Country Club Dr., Covington, LA (US) 70433

( * ) Notice: Subject to any disclaimer, the term of this patent is extended or adjusted under 35 U.S.C. 154(b) by 0 days.

(21) Appl. No.: 09/973,522

(22) Filed: Oct. 9, 2001

(65) Prior Publication Data

US 2003/0066133 A1 Apr. 10, 2003

(51) Int. Cl.[7] ..... A47G 9/04
(52) U.S. Cl. ..... 5/499; 5/482; 5/923
(58) Field of Search ..... 5/499, 490, 482, 5/923

(56) References Cited

U.S. PATENT DOCUMENTS 2,223,568 A * 12/1940 Krasnov ..... 5/499
2,612,646 A * 10/1952 Sussman ..... 5/499
3,241,161 A * 3/1966 Dashosh ..... 5/490
4,164,797 A * 8/1979 Golembeck ..... 5/499
5,566,410 A * 10/1996 Schaechter ..... 5/923
6,065,164 A * 5/2000 Swanger et al. ..... 5/420
6,381,778 B1 * 5/2002 Peterson ..... 5/499

* cited by examiner

*Primary Examiner*—Alexander Grosz
(74) *Attorney, Agent, or Firm*—Keaty Professional Law Corporation

(57) ABSTRACT

A crib mattress cover has a top panel and a bottom panel sewn together and configured to fit over a rectangular crib mattress. One end of the cover is open, and a plurality of securing elements are attached along the opposing edges of the panels, on the interior surfaces thereof. When the securing members, which may be hook and loop fasteners, or a zipper, are joined together, the cover tightly fits over the mattress and cannot be easily dislodged by an infant resting in the crib.

11 Claims, 1 Drawing Sheet

CRIB MATTRESS COVER

BACKGROUND OF THE INVENTION

The present invention relates to a baby crib sheet that prevents the possibility of the sheet from shifting and entangling the arms or legs of the baby as the baby moves in the crib.

Conventional crib mattress sheets are constructed from one panel that has fitted corners to accommodate a rectangular mattress. The fitted corners engage the corners of a crib mattress, similar to a conventional fitted sheet designed for adults. Oftentimes, the elastic that gathers the corners of the sheet becomes stretched and does not secure the sheet on the mattress in a desired manner. When the child rolls, the sheet may disengage from one or two corners of the mattress and cause injury or even suffocation of an infant. Even small babies weighing less than 15 pounds can pull off most of their sheets from the mattresses when shifting in their sleep or trying to move.

Another disadvantage of conventional baby sheets is that when they get soiled they have to be quickly changed, sometimes in the middle of the night. In such cases, the baby has to be lifted form the crib, placed on a safe surface, the soiled sheet has to stripped from the mattress and a new sheet posited thereon. Obviously, this procedure takes time and energy of a sometimes-exhausted baby care giver.

The present invention contemplates elimination of drawbacks associated with the prior art and provision of a crib mattress cover that would be securely positionable on a crib mattress without the possibility of the baby removing or significantly shifting the sheet.

SUMMARY OF THE INVENTION

It is, therefore, an object of the present invention to provide a sheet covering for a crib mattress, which cannot be unraveled by an infant.

It is another object of the present invention to provide a sheet covering that is easily positionable and removable from the mattress for washing.

It is a further object of the present invention to provide a sheet covering that would allow the baby's caretaker to turn over the mattress and position the baby on an unsoiled cover panel.

These and other objects of the present invention are achieved through the provision of a crib mattress cover that comprises a top panel and a bottom panel sewn together along three edges. The panels are configured to form an opening that accommodates a crib mattress therein. One end of the generally rectangular cover is open; it is defined by opposing edges of the panels.

A plurality of securing members, such as hook and loop fasteners are attached along the open edges of the panels. When the securing members are joined together, the panels are stretched to tightly fit the crib mattress. If desired, the closed end of the cover may be fitted to accommodate the rectangular end of the mattress.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 3:
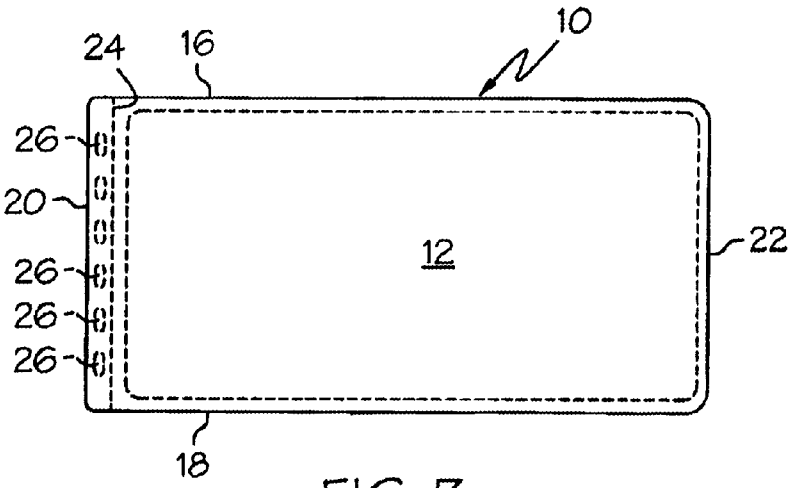
FIG. 3 is a top view of the crib mattress cover secured over the mattress.

Referring now to the drawings in more detail, numeral 10 designates the crib mattress cover in accordance with the present invention. The mattress cover is comprised of a first top panel 12 and a second bottom panel 14. The panels 12 and 14 have a generally rectangular configuration as shown in FIG. 3.

The panels 12 and 14 have elongated sides 16, 18, and shorter ends 20 and 22. The panels 12 and 14 are secured together along side 16, 18 and along the closed end 22. The cover 10 is open along the end 20 of the panels 12 and 14. The edge of each end 20 of the panels 12 and 14 is hemmed, forming a double thickness material that extends from the edge of the panels to a seam 24 stitched 1–2 inches from the edges.

The opposing edges of the panels 12 and 14 along the open ends 20 are generally parallel to each other. The length of the panels 12 and 14 is slightly greater than the length of the mattress, as will be described in more detail hereinafter. As a result, the edges of the open ends 20 extend slightly father than the end of the mattress.

A plurality of securing members 26, which may be hook and loop fasteners, is secured along the edges of the opposing end portions of each panel 12 and 14. The hook and loop fasteners 26 may be pieces of Velcro® material with mating surfaces facing the inner surfaces 28, 30 of the panels 12 and 14.

When the cover 10 is slipped over a mattress 32, the ends 20 of the panels 12 and 14 are secured together, causing the securing members 26 to engage with each other and enclose the mattress 32 entirely. The body of the cover 10 is sized to fit over a standard crib mattress with elongated sides 16 and 18 being slightly longer than the length of the mattress extending outwardly from the end 34 of the mattress. The end 22 of the cover 10, as shown in the drawings, covers the second end 36 of the mattress 32.

The panels 12 and 14 extend over the top and bottom of the mattress 32. If desired, the end 22 of the cover 10 may be made fitted by application of inner seams to the end 22, so that a better fit is achieved over the rectangular end 36 of the mattress 32.

Alternatively, the cover 10, in addition to the panels 12 and 14, may be formed with side inserts 38 fitted between the panels 12 and 14 and secured thereto by conventional running seams. The panels 38 accommodate the height of the mattress 32, enclosing the side vertical portions 40 of the mattress 32.

In operation, the user slips the open end 20 of the cover 10 first over the end 36 of the mattress 32, then pulls the cover 10 along the mattress length, until the free ends 20 of the cover 10 extend outwardly from the end 34 of the mattress 32. The user then brings the ends 20 together, applying slight pressure to the hook and loop fastener elements 26, causing them to attach to the opposing securing members of the mating panel.

The mattress, with a crib cover 10, positioned thereon, is then positioned in the usual manner in the crib, with the user pulling up any excess length of the cover 10 to the end 20 where the panels 12 and 14 are secured. An infant resting in the crib with the cover 10 therein, no matter how vigorous he/she moves, will not be able to disengage the cover 10 from the mattress 32.

Figure 4:
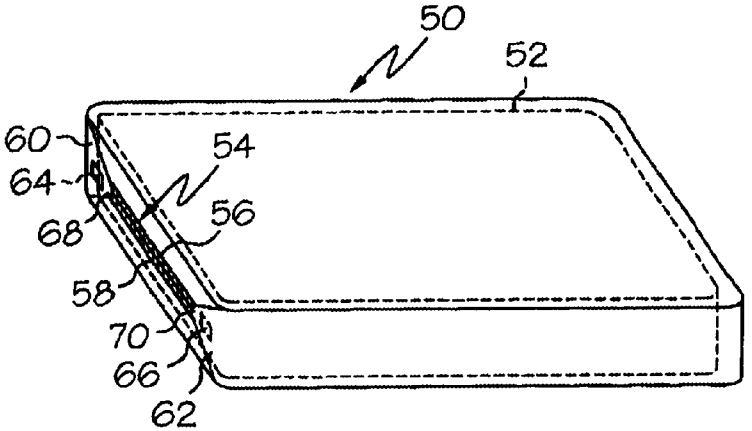
FIG. 4 is a perspective view of another embodiment of the crib mattress cover secured over the mattress.
Figure 1:
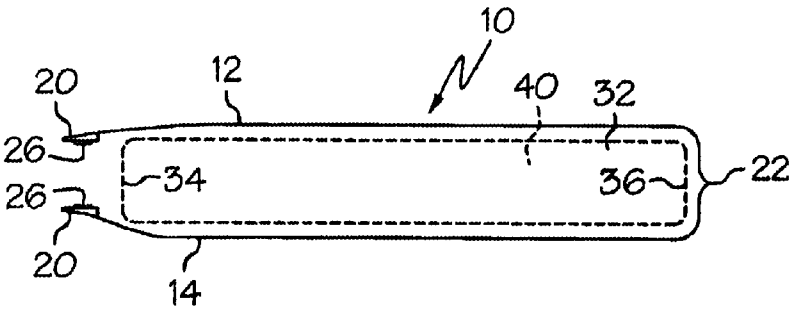
FIG. 1 is a side view of the sheet cover in accordance with the present invention positioned over a mattress.
Figure 2:
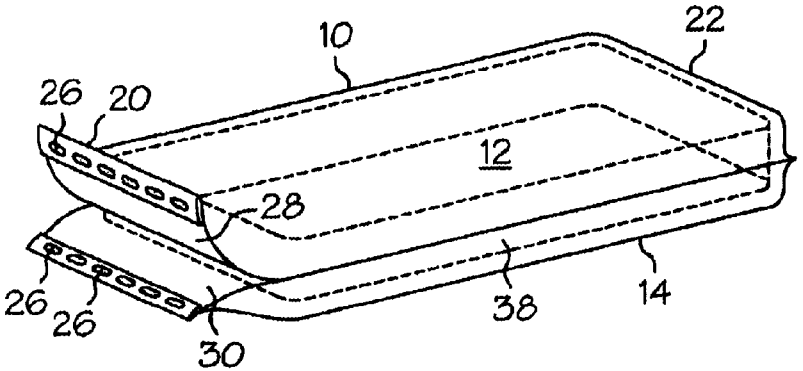
FIG. 2 is a perspective view showing the securing members attached to opposing edges of the open end of the cover.

Turning now to FIG. 4, an alternative closure member is illustrated as used on the crib mattress. As can be seen in the drawing, the cover 50 envelopes the mattress 52 on three sides where it is closed by stitching. One open side of the cover carries a zipper 54, which closes the opposing edges 56 and 58 of the cover 50. When the zipper 54 is closed, the cover 50 forms two "flaps"—the first flap 60 and the second flap 62. These flaps are formed by an excess material that presents itself when the cover 50 is placed over a mattress that has a generally parallelepiped shape.

To secure the flaps 60 and 62, the cover 50 is provided with a pair of hook and loop members 64 and 66 on each flap. A corresponding hook-and-loop member (not shown) is secured on the outer surface of the cover 50 adjacent to the location where the edges 68 and 70 of the flaps 60 and 62 are located when folded over the mattress, as shown in FIG. 4. In operation, the user pulls the cover 50 over the mattress 52 and extends the open end a distance from the narrow end of the mattress 52.

The user then closes the zipper 54, folds the flaps 60 and 62 over at least a portion of the zipper and secures the flaps 60 and 62 by pressing the hook-and-loop members 64 and 66 on the underside of the flaps to the hook-and-loop members on the body of the cover adjacent the zipper 54. In this manner, the tab of the zipper 54 is covered by one of the flaps and will not scratch or injure the infant.

An additional advantage of the two-sided covers 10 and 50 is that in case the top panels gets soiled, the infant's caregiver will be able to simply turn the mattress over and place the child on the unsoiled panels until a convenient time for washing the covers 10 and 50 presents itself.

The mattress cover of the present invention is made from a flame retardant, safe fabric suitable for baby sheets. In the preferred embodiment, the Velcro® fasteners positioned on the inside surfaces of the hemmed portions are preferred since they will not scratch the infant even if the cover gets shifted to expose the ends 20 to the top of the mattress 32.

Since baby crib mattresses are manufactured of standard dimensions, the crib mattress cover 10 will accommodate all types of mattresses and is easily positioned and removed, it can be cleaned in a standard washing machine without a worry about elastic stretching, as would be the case with conventional sheets. Of course, the cover 10 may be made from highly decorative fabric, if desired, as long as it is safe for use in place of baby crib sheets.

Many changes and modifications may be made in the design of the present invention without departing from the spirit thereof. I therefore pray that my rights to the present invention be limited only by the scope of the appended claims.

I claim:

1. A crib mattress cover, comprising:

a generally rectangular top panel and a generally rectangular bottom panel configured to form an opening sized and shaped to receive a crib mattress therein, said cover having an open end defined by opposing edges of the top panel and the bottom panel, and a means attached to interior surfaces of said top panel and the bottom panel for securing the opposing edges and releaseably closing said open end of the cover, said securing means being a zipper, said top panel and said bottom panel forming a pair of flaps adjacent opposite ends of the zipper when the panels are secured together with the zipper, said flaps carrying hook-and-loop fasteners, and wherein matching hook-and-loop fasteners are secured on an outer surface of the panels a distance from an outermost edge of the panels to allow said fasteners to be joined together and cover at least a portion of said zipper.

2. The device of claim 1, wherein said securing means comprises a plurality of securing members, each of said securing members carrying hook and loop fasteners for mating engagement of the securing members of the top panel and the bottom panel.

3. The device of claim 2, wherein said opposing edges are provided with a hem formed in said top panel and said bottom panel to define a double-thickness portion extending along said opposing edges.

4. The device of claim 3, wherein said securing members are attached to said double-thickness portion.

5. The device of claim 2, wherein said securing members are attached a distance from said opposing edges.

6. The device of claim 1, wherein said top panel and said bottom panel are sewn together along elongated sides and a closed end, and wherein said closed end is configured to fit a rectangular end of the crib mattress.

7. The device of claim 1, wherein said top panel and said bottom panel each have a length greater than the length of the mattress to accommodate the thickness of the mattress.

8. A crib mattress cover, comprising:

a generally rectangular top panel and a generally rectangular bottom panel configured to form an opening sized and shaped to receive a crib mattress therein, said cover having an open end defined by opposing edges of the top panel and the bottom panel, and a means attached to the opposing edges of said top panel and the bottom panel for securing the opposing edges and releaseably closing said open end of the cover, said securing means comprising a zipper, said top panel and said bottom panel forming a pair of flaps adjacent opposing ends of the zipper when the panels are secured together with the zipper, said flaps carrying hook-and-loop fasteners, and wherein matching hook-and-loop fasteners are secured on an outer surface of the panels a distance from an outermost edge of the panels to allow said fasteners to be joined together and cover at least a portion of said zipper.

9. A method of enclosing a crib mattress, comprising the steps of:

providing a mattress cover comprised of a generally rectangular top panel and a generally rectangular bottom panel configured to form an opening sized and shaped to receive a crib mattress therein, said cover having an open end defined by opposing edges of the top panel and the bottom panel, and a plurality of securing members attached to interior surfaces of said top panel and said bottom panel;

inserting the mattress into said opening and moving said opposing edges away from an end of the mattress;

securing the opposing edges of the top panel and the bottom panel by engaging the securing members together, thereby releaseably closing said open end of the cover and enclosing the mattress in the cover, said securing members comprising a zipper;

forming a pair of flaps on opposite ends of the zipper and providing a fastener on each of said flaps and on said panels; and securing said fasteners on said flaps and said panels, thereby covering at least a portion of said zipper.

10. The method of claim 9, wherein said top panel and said bottom panel each have a length slightly greater than the length of said mattress, such that the cover tightly fits over the mattress when the securing members are joined to close the open end of the cover.

11. The method of claim 9, wherein said top panel and said bottom panel are sewn together along elongated sides and a closed end, and wherein said closed end is configured to fit a rectangular end of the crib mattress.

* * * * *